US006600121B1

(12) United States Patent
Olodort et al.

(10) Patent No.: US 6,600,121 B1
(45) Date of Patent: Jul. 29, 2003

(54) MEMBRANE SWITCH

(75) Inventors: Robert Olodort, Santa Monica, CA (US); John Tang, San Carlos, CA (US); Peter M. Cazalet, Campbell, CA (US)

(73) Assignee: Think Outside, Inc., Carlsbad, CA (US)

( * ) Notice: Subject to any disclaimer, the term of this patent is extended or adjusted under 35 U.S.C. 154(b) by 0 days.

(21) Appl. No.: 09/989,831

(22) Filed: Nov. 19, 2001

Related U.S. Application Data

(60) Provisional application No. 60/252,604, filed on Nov. 21, 2000.

(51) Int. Cl.[7] ..... H01H 13/36
(52) U.S. Cl. ..... 200/516; 200/406
(58) Field of Search ..... 200/343, 516, 200/406, 512

(56) References Cited

U.S. PATENT DOCUMENTS 3,969,595 A * 7/1976 Johnson ..... 200/516 X
4,066,860 A * 1/1978 Kawasaki ..... 200/516 X
4,127,752 A * 11/1978 Lowthorp ..... 200/516 X
4,338,502 A * 7/1982 Hashimoto et al. ..... 200/343

* cited by examiner

*Primary Examiner*—Renee Luebke
(74) *Attorney, Agent, or Firm*—Blakely, Sokoloff, Taylor & Zafman LLP

(57) ABSTRACT

A spring coupled to a multi-layered flex membrane is described. In one embodiment, the spring may be a layer coupled to the top layer of a key switch membrane. In another embodiment, the spring may be coupled to the key switch between a top layer and a spacer layer. The spring or spring layer may increase the resiliency of the key switch membrane to prevent the flex membrane from deforming.

4 Claims, 14 Drawing Sheets

MEMBRANE SWITCH

This application is a non-provisional application. This application is related to and claims the benefit of U.S. provisional application 60/252,604 entitled "Membrane Switch," filed Nov. 21, 2000.

FIELD OF THE INVENTION

The invention relates generally to key switch assemblies and, more specifically, to key switches in keyboards for compact or portable use.

BACKGROUND OF THE INVENTION

Key switches for various types of keyboards, such as computer keyboards, are well known in the art. Typically, these keyboards include a scissor linkage that supports a key cap. When the key cap is depressed, a dome under the key cap causes a switch to be closed. The scissor linkage supports the key cap and allows it to move up and down during use. The dome may serve as a spring and also serve to provide the electrical contact between two conductive traces that are situated below the key cap.

Key switches may include a flex membrane. The flex membrane typically consists of multiple layers. A base layer and a top layer may include one or more electrical contact points that contact each other to complete an electrical circuit, thereby registering a key stroke. A spacer layer separates the base layer and the top layer in an open, or extended key position. The scissor linkage may be secured to the flex membrane with a key cap resting on top of the linkage.

While conventional scissor linkages for keys and key switches are useful for desktop keyboards, they do tend to require a large vertical space. Thus, such key switches are not conducive for use in folding keyboards, which are designed to fold into small spaces when not in use. Co-pending U.S. patent application Ser. No. 09/540,669, filed Mar. 31, 2000, entitled "Foldable Keyboard," describes an example of such a foldable keyboard. This application is hereby incorporated herein by reference. Folding keyboards often require thinner key switches than are used in desktop or laptop computers. The thinner the key switch, the thinner the final folded keyboard assembly can be made.

One problem of membrane switches is that the layers deform with use. This problem is especially prevalent in small, folding keyboards. Folding keyboards often require very thin key switches compared to desktop or laptop computer keyboards. Key switches designed for use in foldable or collapsible keyboards have a tendency over time to be deformed into a shape that is caused by being depressed over long periods of time. When folded, the key switches may have a tendency to remain in the closed position. Because of the thin key switches, the membranes deform easily. Over time, the key switch may deform to a closed position, even when the keyboard is unfolded. The keys may become permanently shorted rendering the keyboard inoperable.

SUMMARY OF THE INVENTION

A spring coupled to a multi-layered flex membrane is described. In one embodiment, the spring may be a layer coupled to the top layer of a key switch membrane. In another embodiment, the spring may be coupled to the key switch between a top layer and a spacer layer. The spring or spring layer may increase the resiliency of the key switch membrane to prevent the flex membrane from deforming.

BRIEF DESCRIPTION OF THE DRAWINGS

The present invention is illustrated by way of example, and not limitation, in the figures of the accompanying drawings in which.

DETAILED DESCRIPTION

The present invention relates to a key switch assembly. In the following description, numerous specific details are set forth such as examples of specific materials, components, dimensions, etc. in order to provide a thorough understanding of the present invention. It will be apparent, however, to one skilled in the art that these specific details need not be employed to practice the present invention. Moreover, the dimensions provided are only exemplary.

In other instances, well known components or properties have not been described in detail in order to avoid unnecessarily obscuring the present invention. In addition, the various alternative embodiments of a key switch or spring described in relation to a particular figure may also be applied to the key switches and springs described in other figures.

The method and apparatus described herein may be implemented with a collapsible or foldable keyboard. It should be noted that the description of the apparatus in relation to a collapsible keyboard is only for illustrative purposes and is not meant to be limited only to collapsible keyboards. In alternative embodiments, the apparatus described herein may be used with other types of keyboards, for examples, a desktop computer keyboard, a notebook computer keyboard, a keyboard on a personal digital assistant (PDA) device or a keyboard on a wireless phone.

The present invention relates to a key switch assembly. A spring or spring layer coupled to a flex membrane of a key switch is described. The spring increases the resiliency of the key switch to better withstand repeated key presses during use, or long periods of continuous key pressing, such as when a keyboard is in a folded position. The spring adds negligible thickness to the key switch assembly as not to affect the folding or of standard operation of the keyboard, such as key travel and tactile feedback.

The spring may take any number of forms. In one embodiment, the spring may be a coil. In another embodiment, the spring may be a ring with a cantilever arm extending from the ring. In another embodiment, the spring may be a ring with a beam connected across a diameter or length of the ring. In another embodiment, the beam may be bowed to increase further the resiliency of the spring.

In one embodiment, the spring may be coupled as a discrete part of the flex membrane assembly. In another embodiment, the spring may be coupled to the flex membrane as part of a sheet of springs aligned over a key switch array. This method may, from a manufacturing perspective, decrease costs.

Figure 1A:
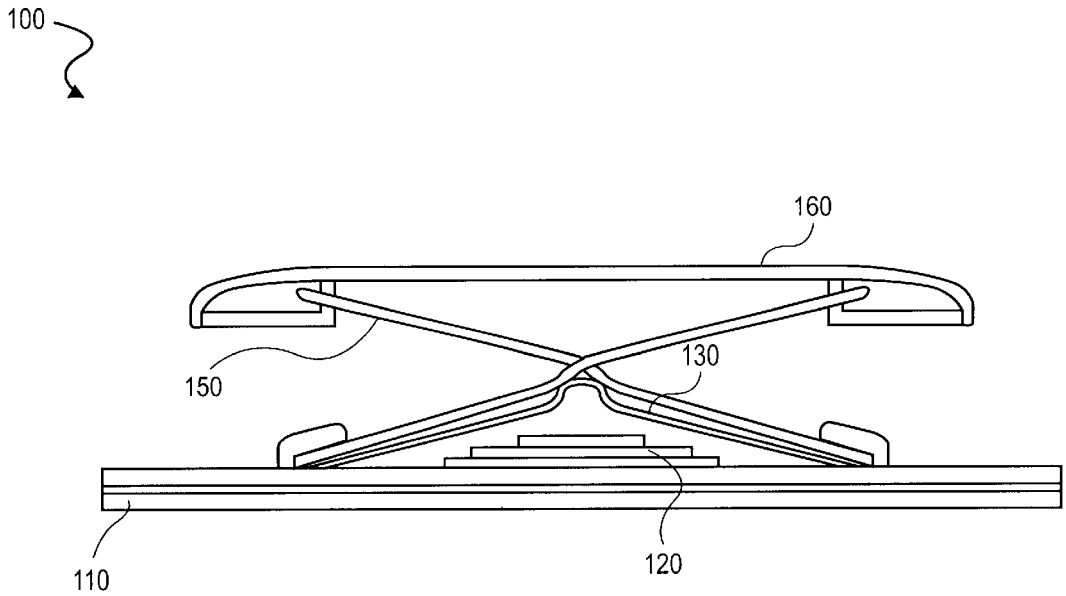
FIG. 1A is a cross-sectional side view illustrating one embodiment of a key switch assembly in an extended position.

FIG. 1A shows a cross-sectional view illustrating one embodiment of a key switch assembly in an extended or open position. Key switch 100 is shown in the extended position when a key is not depressed either by a user, or by the collapsing or folding of a keyboard on which the key is contained. In one embodiment, key switch assembly 100 includes flex membrane 110, first spring 120, second spring 130, linkage 150, and key cap 160. Optionally, a base plate (not shown) may be placed between flex membrane 110 and first spring 120. The base plate may provide rigid support for first spring 120 and linkage 150 resting on flex membrane 110.

Figure 1B:
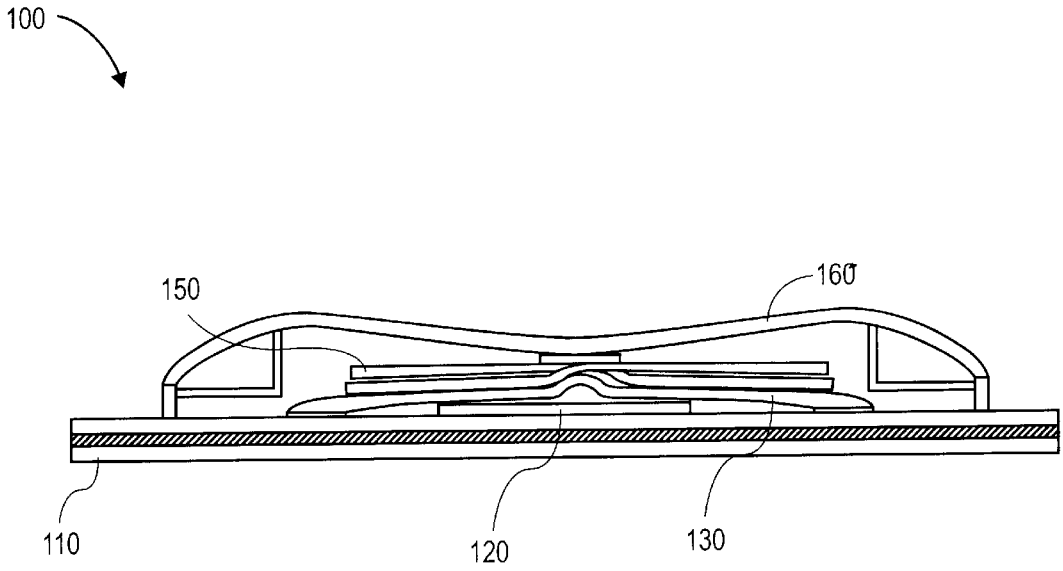
FIG. 1B is a cross-sectional side view illustrating one embodiment of a key switch assembly in a closed position.

When a user presses down on key switch 100, linkage 150 collapses and second spring 130 compresses until linkage 150 lays flat in approximately a common plane, as illustrated in FIG. 1B. Second spring 130 may have various embodiments. Pending U.S. patent application, Ser. No. 09/738,000, filed Dec. 14, 2000, entitled "Keyswitch," describes a spring having an unitary body. The unitary body may be substantially bowed between the ends. This application is hereby incorporated herein by reference.

When key switch 100 moves to the extended position, second spring 130 decompresses and pushes up on linkage 150. Linkage 150 may be referred to in the art by various terms, such as "scissor" linkage. Regardless of the particular term used, the linkage is a component that forms a scissor-like action when a key is pressed. An example of a linkage in key switch assemblies is found in pending U.S. patent application Ser. No. 09/737,015, filed Dec. 14, 2000, entitled "Spring," the contents of which is hereby incorporated by reference herein.

Flex membrane 110 is a flexible conductor that may be used to actuate the electrical operation of a key switch. Flex membrane 110 may consist of one or more layers of flexible material disposed on or in a flexible film. When key switch 100 is depressed into a closed position, as illustrated in FIG. 1B, two conductive traces (not shown) within flex membrane 110 contact each other to complete an electrical circuit. This electrical circuit corresponds to a keystroke, and may be registered to a user on a display, such as a computer monitor. Flex membranes are known in the art; accordingly, a more detailed discussion is not provided herein.

First spring 120 is coupled to a top surface of flex membrane 110. In the down keystroke position, as illustrated in FIG. 1B, first spring 120 compresses when contacted by second spring 130. First spring is generally made of resilient, metal-based materials. As such, first spring 120 may increase the resiliency of flex membrane 110 to return to an extended position, compared to a flex membrane without spring 120. First spring 120 may prevent flex membrane 110 from deforming through use. In doing so, first spring 120 may extend the operating life of the key switch, and may be particularly advantageous to foldable or portable keyboards, whose keys are subjected to prolonged periods of compression.

Figure 2:
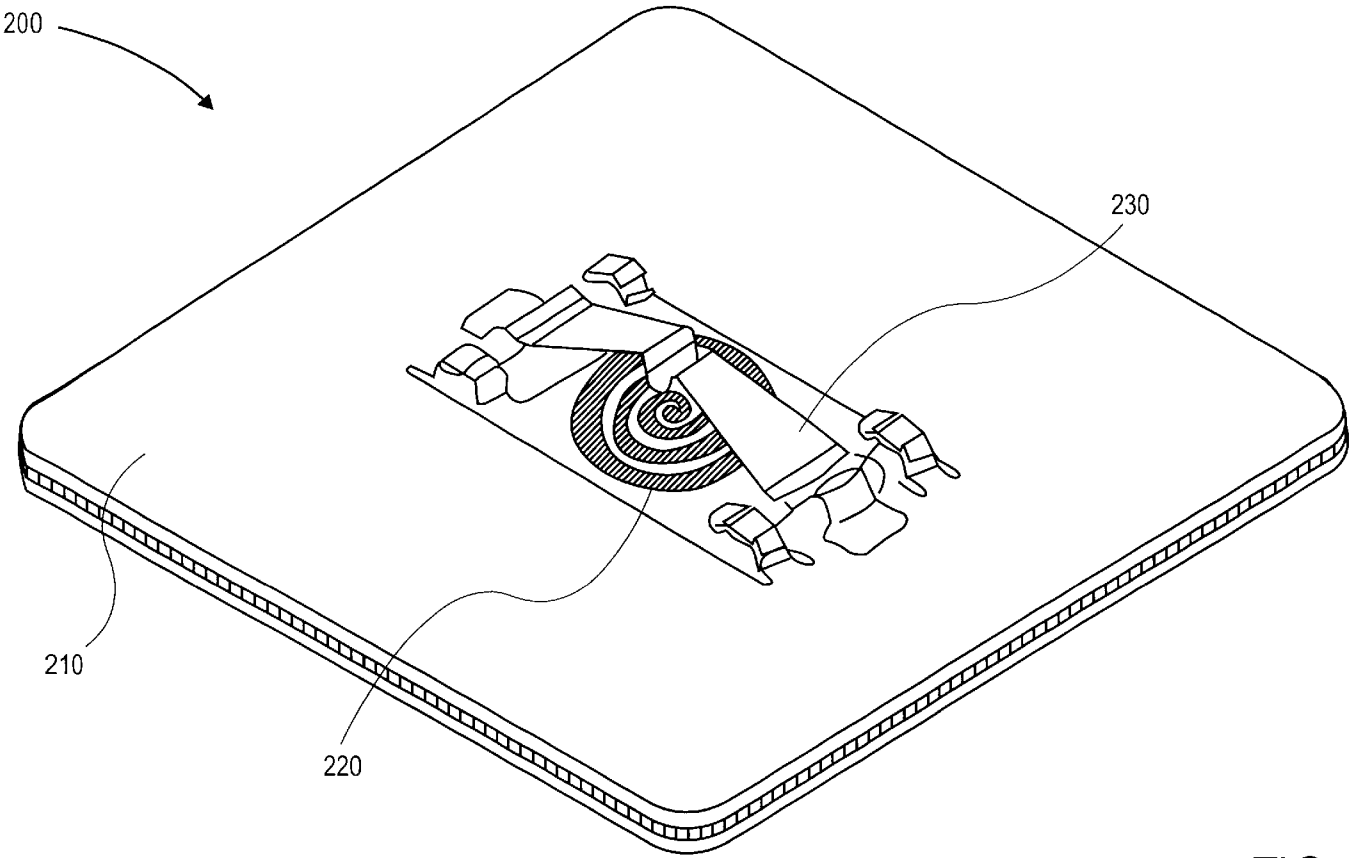
FIG. 2 is a perspective view illustrating one embodiment of a key switch assembly.

FIG. 2 shows a top perspective view illustrating one embodiment of a key switch assembly. Key switch 200 includes flex membrane 210, first spring 220, and second spring 230. In one embodiment, a scissor linkage and key cap (not shown) may rest on top of second spring 230. Pending U.S. patent application Ser. No. 09/737,015, filed Dec. 14, 2000, entitled "Keyswitch," describes a linkage structure having two legs interleaved together without a pivot point approximately central to the legs. This pending application is hereby incorporated herein by reference.

First spring 220 is coupled to a top side or surface of flex membrane 210. First spring 220 is centered under second spring 230. During a keystroke, a center portion of second spring 230 presses down on first spring 220 that in turn compresses the layers of flex membrane 210. In an alternative embodiment, second spring 230 may be a metal spring or a rubber dome.

As described above, flex membrane 210 may include conductive traces (not shown) that make contact with each other when compressed. First spring 220 helps flex membrane 220 return to an uncompressed, extended position when the key is released.

Figure 3:
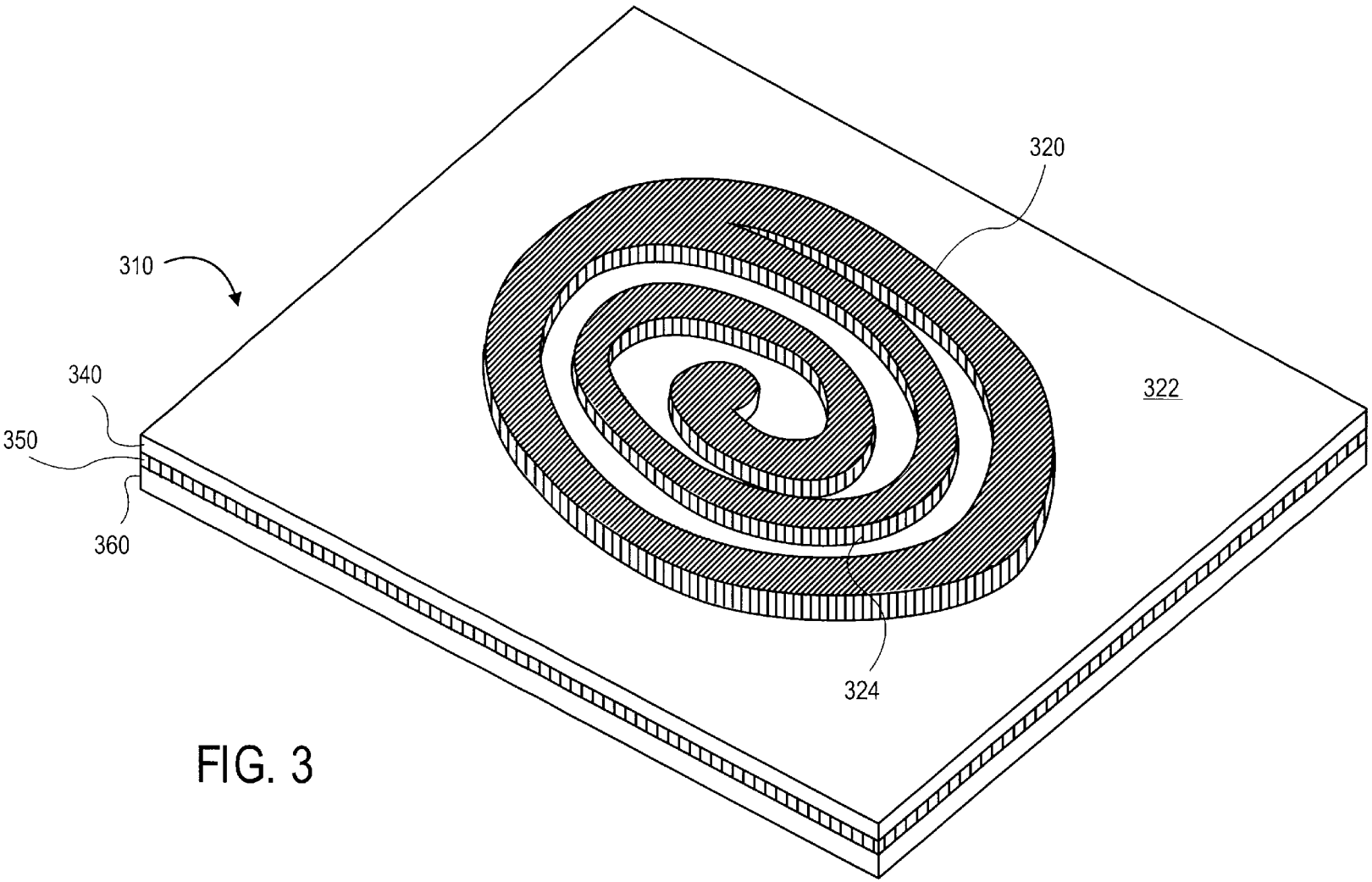
FIG. 3 is a perspective view illustrating one embodiment of a spring in relation to a flex membrane.

FIG. 3 shows a top perspective view of one embodiment of the key switch assembly of the present invention. The key switch includes flex membrane 310 and spring 320. As described above, flex membrane 310 is a flexible conductor that is used to actuate the electrical operation of a key switch.

In one embodiment, flex membrane 310 has base layer 360, spacer layer 350 and top layer 340. Electrical contacts (not shown) on a bottom side of top layer 340 and a top side of base layer 360 are separated by spacer layer 350. In an extended key switch position (i.e., when the key is not pressed), the spacer layer separates the electrical contacts of top layer 340 and base layer 360. In a closed key switch position (i.e., when the key is depressed during operation), the contacts complete an electrical circuit to register a keystroke, for example, on a display.

In one embodiment, spring 320 is coupled to a top side or surface of top layer 340. Spring 320 may be designed to produce optimal spring effect. In one embodiment, spring 320 is shaped as a spiral coil. Spring 320 has an outer ring 322 with coiling rings 324 extending from outer ring 322.

Figure 4:
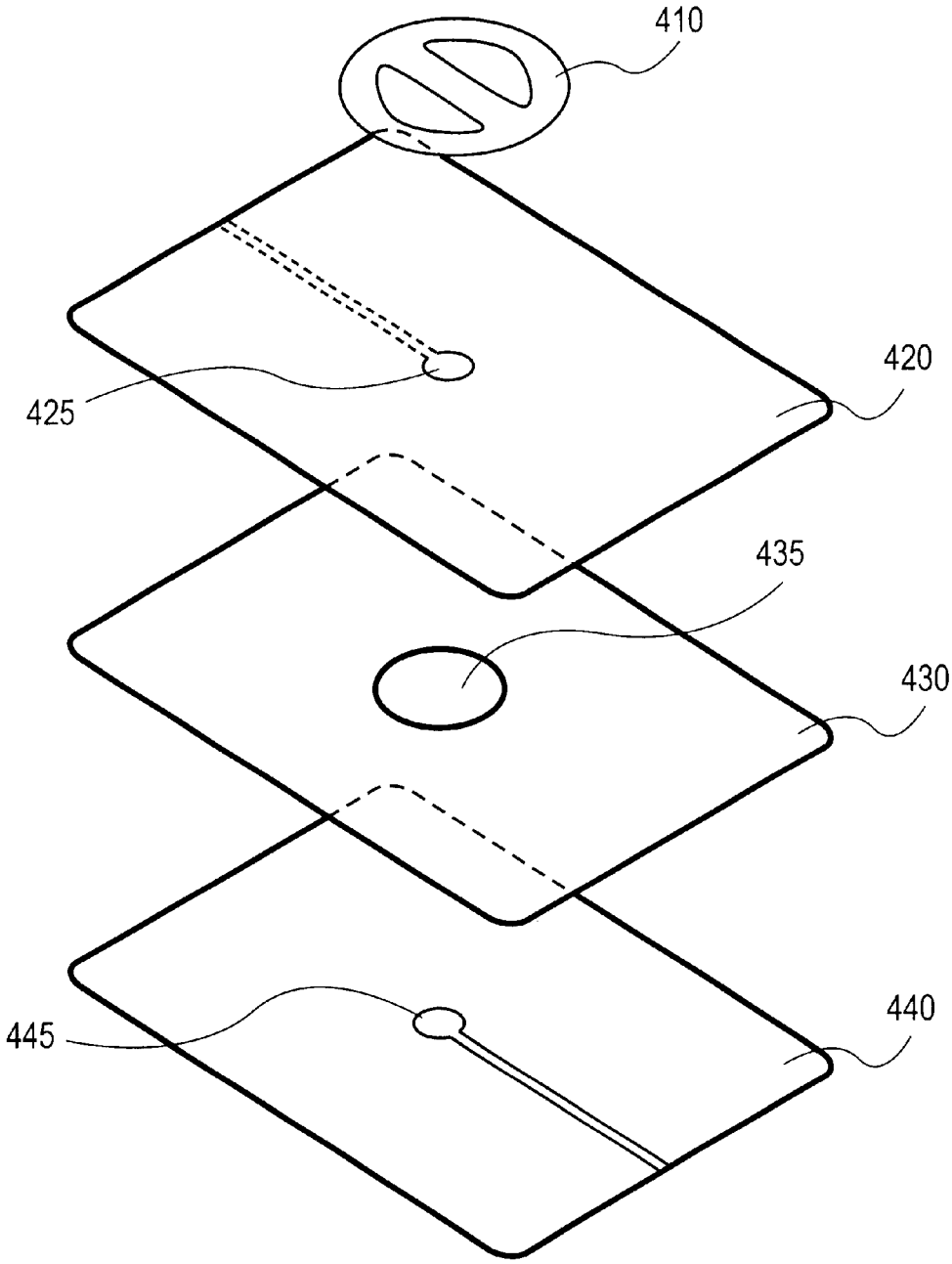
FIG. 4 is an exploded view illustrating one embodiment of a spring and flex membrane assembly.

FIG. 4 illustrates an exploded view of one embodiment of a flex membrane with a spring of the present invention. The flex membrane is a multi-layered assembly that completes an electrical circuit to register a key press. The flex membrane includes base layer 440, spacer layer 430, and top layer 420. Base layer 440 has conductive trace 445 extending from an end of base layer 440 to a center region. Similarly, top layer 420 has conductive trace 425 extending to a center region. Conductive tracers 425, 445 have enlarged contact areas at the center regions of top layer 420 and base layer 440, respectively.

Spacer layer 430 allows the enlarged contacts areas of conductive traces 425, 445 to oppose each other without obstruction. Spacer opening 435 creates an air gap between conductive traces 425, 445. In one embodiment, spacer opening 435 is substantially circular. It should be noted that spacer opening 435 may be a variety of sizes and shapes to expose conductive traces 425, 445.

In an extended key switch position, spacer layer 430, because of its thickness, prevents conductive traces 425, 445 from making contact with each other. In a closed key switch position, top layer 420 flexes downward allowing top trace 425 to travel across the thickness of spacer layer 430 through opening 435 and contact bottom trace 445. Conductive traces 425, 445 are each connected to a circuit board of the keyboard (not shown).

Spring 410 is positioned on top of top layer 420. In one embodiment, spring layer 410 is substantially centered on top layer 420 as to cover the enlarged contact area of top trace 425. Centering the position of spring 410 over top trace 425 allows the minimal amount of actuation force needed for top trace 425 and bottom trace 445 to make contact with each other.

In one embodiment, the layers of the flex membrane are heat tacked together. In another embodiment, the layers of the flex membrane are coupled together with an adhesive. The layers can be bonded with pressure sensitive adhesive ("PSA"), double sided tape, or thermo set materials. Methods for assembling flex membranes are known in the art; accordingly, a detailed discussion is not provided herein.

In one embodiment, 3-layer flex membranes measure 0.3 millimeters in thickness. A standard key, when fully compressed, measures 3.5 millimeters in thickness. Spring 410 measures approximately 0.1 millimeters. Thus, spring 410 will add approximately 0.1 millimeters to the thickness of the flex membrane. The minimal thickness of spring 410 is insignificant and may not affect the ability of a keyboard to fold or compress fully when in the folded position to minimize the thickness of a folded keyboard.

During a folded keyboard position, a key switch may be fixed in a closed position for extended periods. In time, constant pressure applied to the flex membrane may cause top layer 420 to deform. Top layer 420 of the flex membrane is usually made of Mylar or polyester-type materials, so that top layer 420 will easily bow towards base layer 440 in the closed key switch position. However, over time, top layer 420 may lose resiliency and fail to return to a straightened position after key depression. However, spring 410, coupled to top layer 420, may increase the resiliency of the flex membrane to return flex membrane to the open position.

Spring 410 is usually made of a material having elastic and resilient properties. In one embodiment, spring 410 is made of a metal-based material, for example, hardened stainless steel because of its high "springing" properties. Other materials that may be used for spring 410 may include phosphor bronze and beryllium copper.

In one embodiment, spring 410 may have a diameter or length (depending on the shape of the spring) that is approximately equal to or greater than the length of spacer opening 435. Spring 410 may need to provide an upward force that opposes the downward force when the key switch compressed during a keystroke or when the keyboard folds. By having a portion of spring 410 exceeding the diameter or length of spacer opening 435, a sufficient amount of upward force is applied to spring top layer 420 and corresponding top conductive trace 425 to the open position.

As illustrated in FIG. 4, spring 410 may be shaped as a ring with a beam across a diameter of the ring. In one embodiment, the ring portion of spring 410 may be positioned on top layer 420 as to be outside of spacer ring 435. As such, when a downward force is applied on spring 410, only the beam portion of ring 410 presses down on top conductive trace 425 to complete an electrical circuit with bottom conductive trace 445 through spacer opening 435. An opposing, upward force applied by the ring portion of spring 410 provides the return force to "spring" top layer 420 to the open position when the key is released.

It should be noted that the spring coupled to the top layer of the flex membrane does not require a ring structure. In another embodiment, the spring may be shaped as a bowed beam without a ring portion. The beam spring is bowed such that a larger gap exists between the top and bottom layers of the flex membrane in the open position of the key switch. Alternatively, bowed spring may be bonded to the top layer, causing the top layer to bow as well.

In the closed position, the center portion of the beam spring flexes downward to make contact with the top layer, thereby forcing contact between top and bottom conductive trace. In this embodiment, the length of the beam spring may be greater than a length or diameter of the spacer opening. As such, only the end portions of the beam spring may be coupled to the top layer of the flex membrane. In one embodiment, a discrete spring coupled to the top layer of a flex membrane may have up to 2 millimeters overlap with the spacer opening of the spacer layer.

Figure 5:
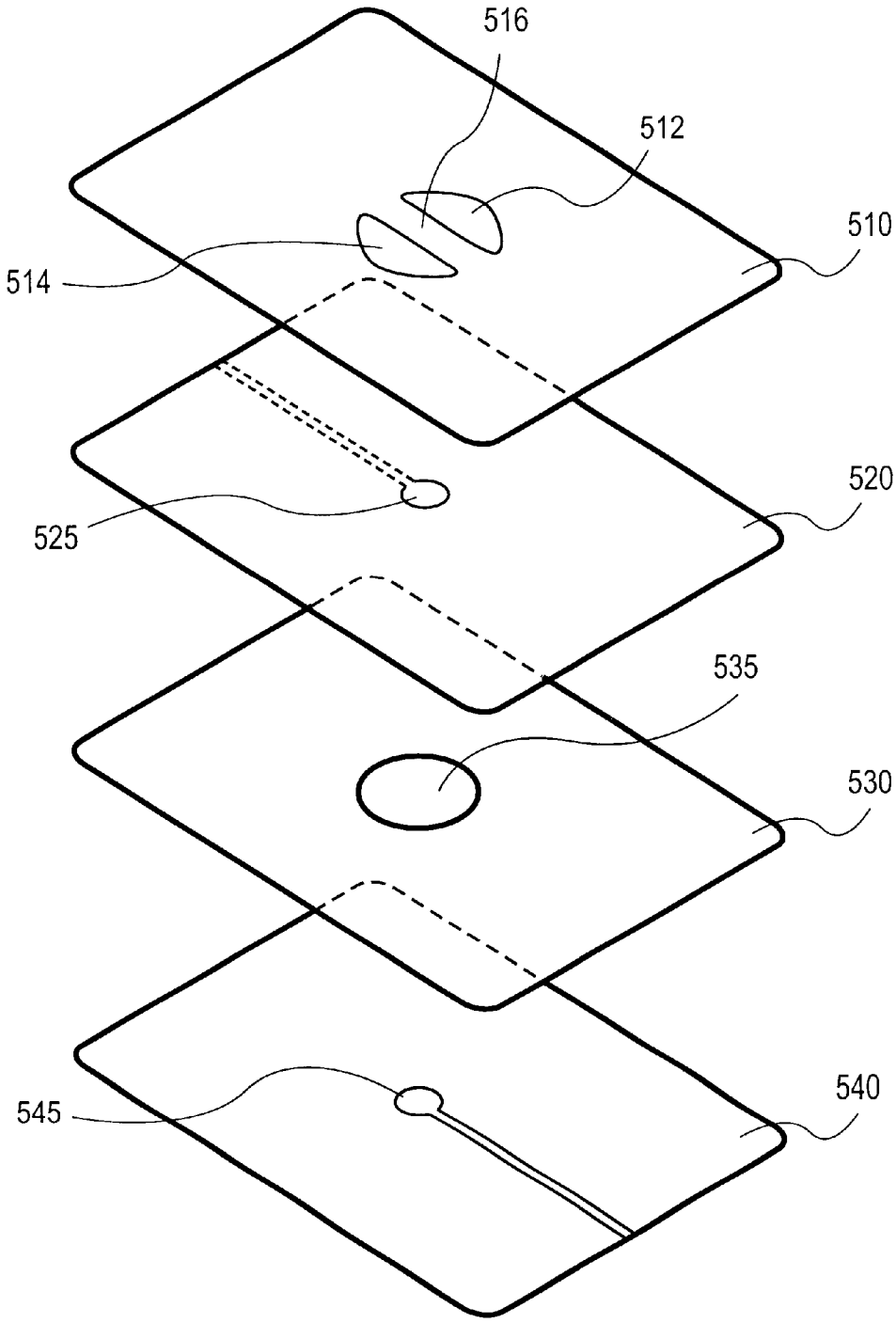
FIG. 5 is an exploded view illustrating one embodiment of a spring and flex membrane assembly.

FIG. 5 is an exploded view illustrating an alternative embodiment of a spring coupled to a flex membrane. Similar to the flex membrane described in FIG. 4, the flex membrane in FIG. 5 includes top layer 520, spacer layer 530, and base layer 540. In one embodiment, spring 510 may be an enlarged layer substantially equal to the size of the three layers of the flex membrane. The thickness of spring 510 may be substantially equal to spring 410 of FIG. 4 as described above. Spring 510 may be a layer of metal-based material with resilient properties.

In one embodiment, spring 510 has two semi-circular openings 512, 514 to form beam 516 near center region of spring 510. Beam 516 may be centered over the enlarged center region of top conductive trace 525. An actuation force applied to beam 516 of spring 510 results in top trace 525 and bottom trace 545 completing a circuit to register a key stroke.

It should be noted that beam 516 is just one of several possible embodiments for spring 510. Other embodiments for the spring will be discussed in subsequent figures.

From an assembly perspective, spring 510 may be more desirable compared to spring 410. For example, to center beam 516 over top conductive trace 525, it may be easier to align spring 510 with top layer 520 because, as layers, they are both substantially the same size. In contrast, a discrete spring such as spring 410 may require expensive instruments to center spring 410 over top conductive trace 525.

In addition, the design of spring 510 provides a large surface area for coupling spring 510 to top layer 520. The adhesive used to couple spring 410 to the top layer may weaken over time, ultimately separating spring 410 from the top layer. In contrast, the large surface area of spring 510 may increase the likelihood that it may not detach from top layer 520 over time.

Figure 12:
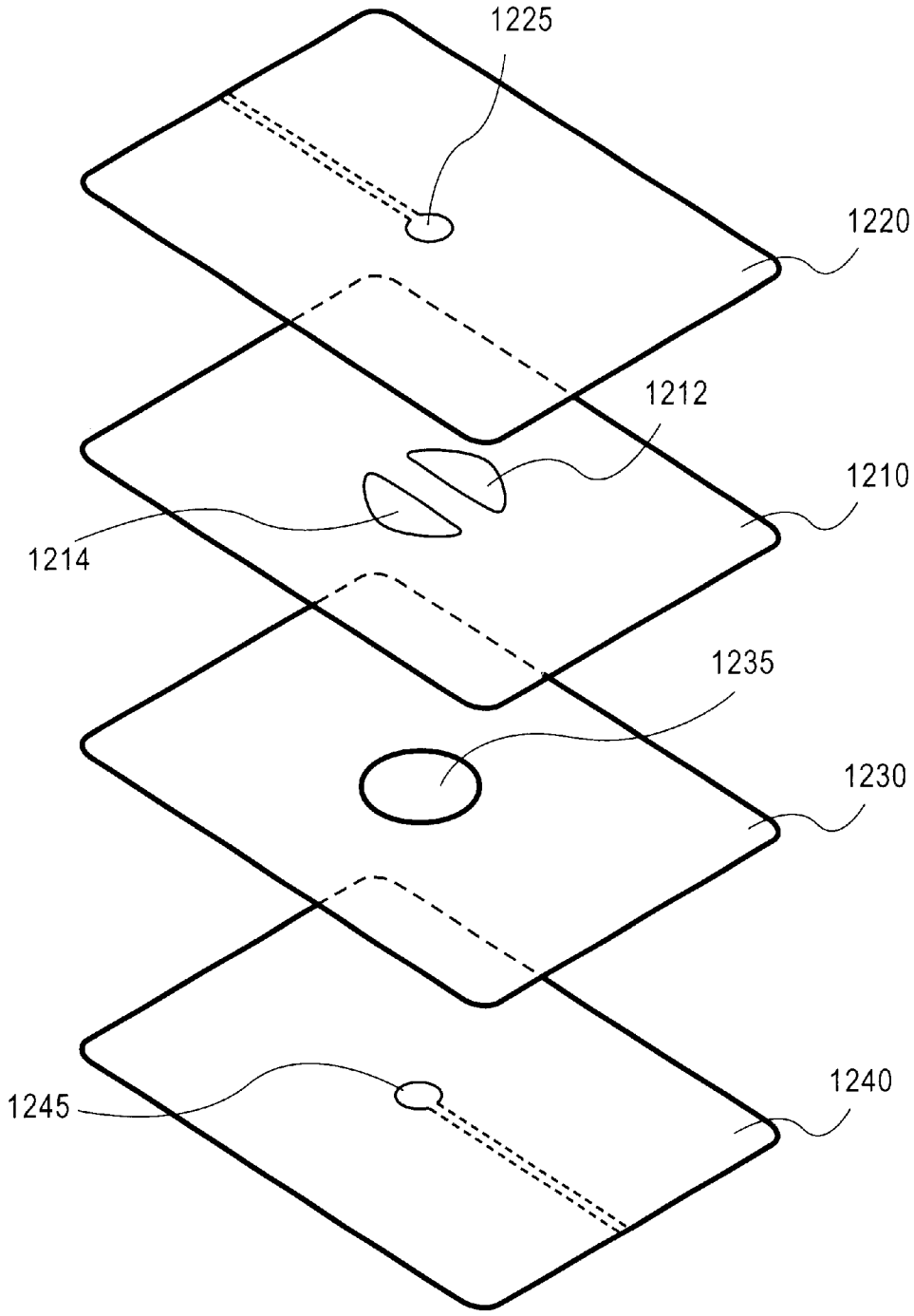
FIG. 12 is an exploded view illustrating one embodiment of a spring and flex membrane assembly.

FIG. 12 is an exploded view illustrating an alternative embodiment of a spring coupled to a flex membrane. The flex membrane includes top layer 1220, spacer layer 1230 and base layer 1240. Spring 1210 may be disposed between top layer 1220 and spacer layer 1230. In this embodiment, a downward force applied to top layer 1220 results in a closed circuit of top conductive trace 1225, spring beam 1216 and bottom conductive trace 1245. Positioned between top layer 1220 and spacer layer 1230, spring 1210 may provide resiliency support to top layer 1220 similar to spring 1210 positioned on top of top layer 1220. Thus, spring 1210 in this position may also prevent top layer 1220 from deforming over time.

In addition, positioning spring 1210 between top layer 1220 and spacer layer 1230 may secure spring 1210 in place because both a top surface and a bottom surface of spring 1210 is coupled to the flex membrane, and because spring 1210 pushes up towards top layer 1220. In contrast, if spring 1210 were coupled to the top of top layer 1220, as illustrated in FIGS. 4 and 5, spring 1210 pulls up on top layer 1220. With spring positioned between top layer 1220 and spacer layer 1230, there may be less likelihood of spring 1210 separating from the flex membrane. As discussed above, coupling spring 1210 to a top surface of the top layer may result in spring 1210 separating from the top layer over time.

Figure 6A:
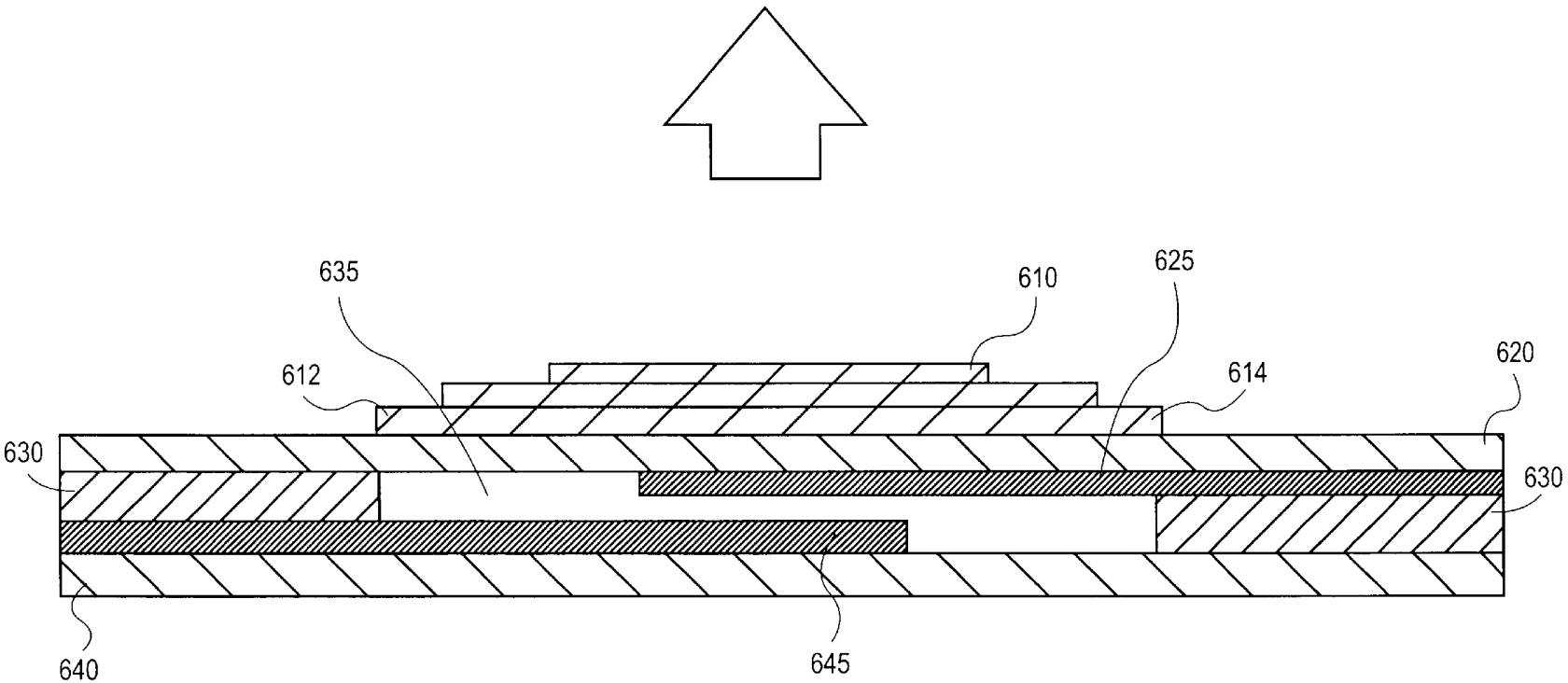
FIG. 6A is a cross-sectional side view illustrating one embodiment of a spring and flex membrane in an open position.
Figure 6B:
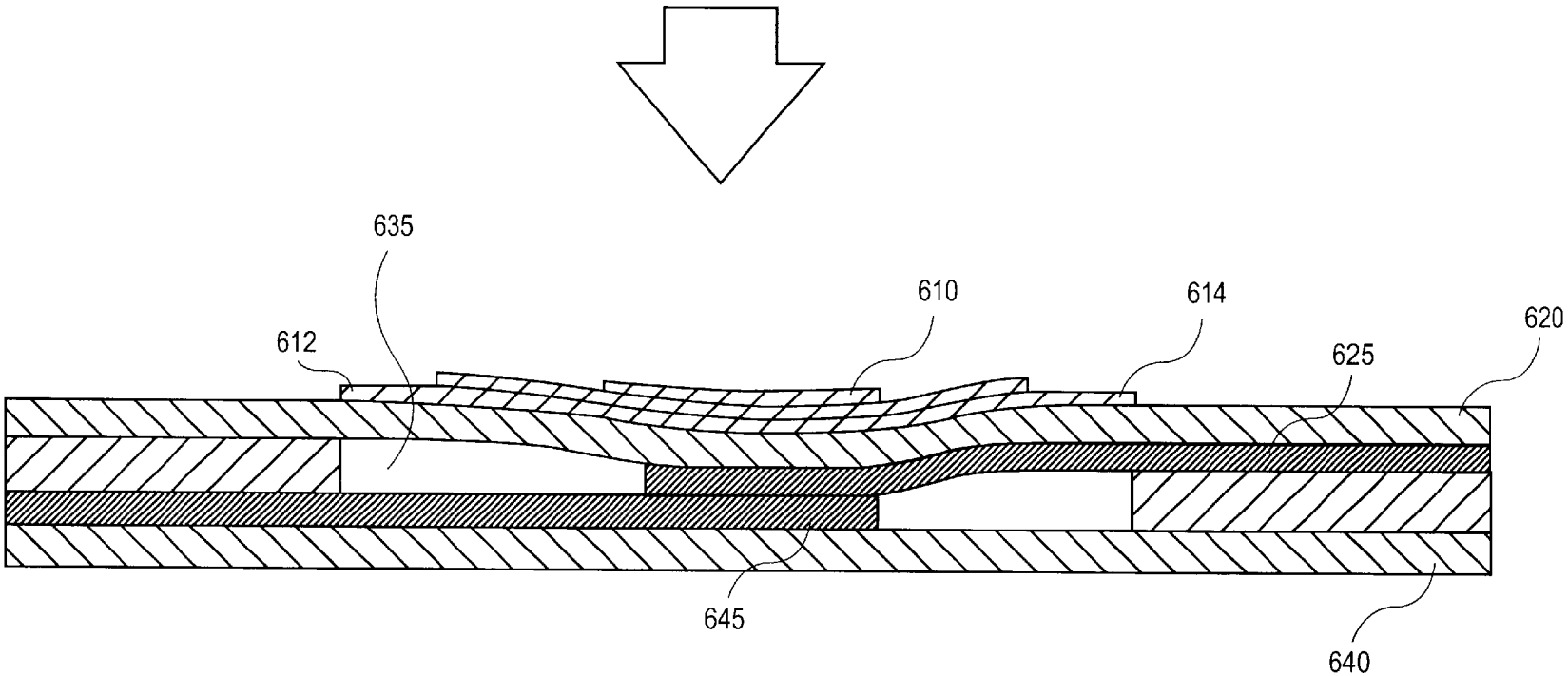
FIG. 6B is a cross-sectional side view illustrating one embodiment of a spring and flex membrane in a closed position.

FIGS. 6A, 6B illustrate one embodiment of a cross-sectional, side view of a flex membrane with a spring in an open and a closed position, respectively. Flex membrane includes base layer 640, spacer layer 630, and top layer 620. Spring 610 is coupled to a center portion of top layer 620. Spring 610 has coils of decreasing radius gradually rising towards the center of spring 610.

Top conductive trace 625 extends along a bottom side of top layer 620 towards a center region. Bottom conductive trace 645 extends along a top side of base layer 640 towards a center region such that top conductive trace 625 and bottom conductive trace 645 overlap. Spacer layer 630 separates top conductive trace 625 and bottom conductive trace 645 in the open key switch position. Spacer opening 635 exposes top conductive trace 625 and bottom conductive trace 645 to each other through spacer opening 635.

In one embodiment, spring 610 is coupled to top layer 620 such that ends 512, 514 of spring 610 overlap spacer opening 635 through top layer 620. As illustrated in FIG. 6B, when an actuation force is applied to the flex membrane, the coils of spring 610 compress, and top layer 620 flexes or bows allowing top conductive trace 625 to contact bottom conductive trace 645.

A support plate (not shown) usually supports base layer 640 to prevent the entire flex membrane from bending in the closed key switch position. Because ends 512, 514 of spring 610 overlaps spacer 630 over top layer 620, an opposing force is applied against the downward force against top layer 620. When a key is released, spring 610 aids top layer 620 to return to the open key switch position. In dong so, spring 610 may prolong the operational life of the flex membrane by preventing top layer 620 from deforming to a closed key switch position.

FIGS. 7–10 illustrate various embodiments for the spring of the present invention. In general, any design for a spring coupled to a top layer of a flex membrane should have light actuation force, such that the amount of compressing force required make the top and bottom conductive traces contact each other should be minimal. In one embodiment, up to 20 grams of force may be required to compress or deflect a spring coupled to the top layer of a flex membrane.

Figure 7:
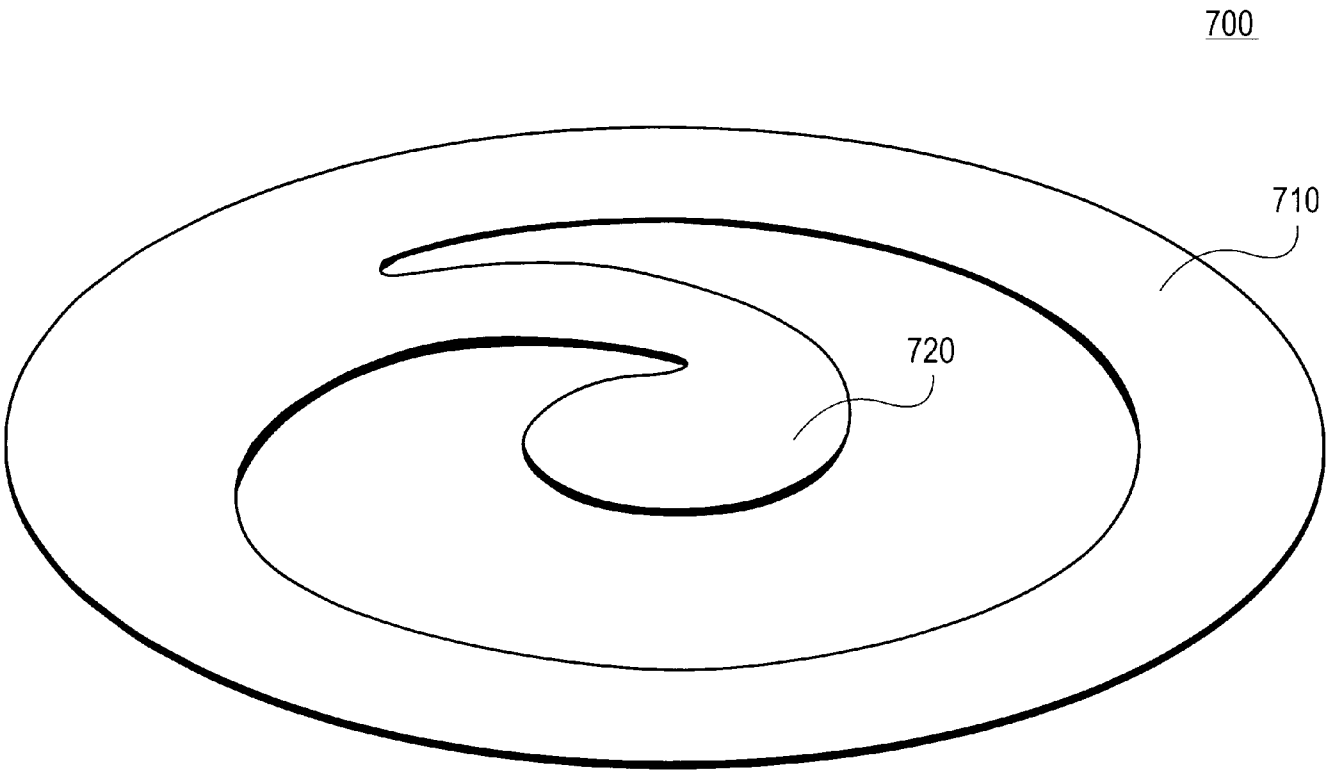
FIG. 7 is a top planar view illustrating one embodiment of a spring.

FIG. 7 illustrates one embodiment of a spring to couple to the top layer of a flex membrane. Spring 700 has ring portion 710 and spring arm portion 720. Spring arm portion extends from ring portion 710 towards a center region and enlarges to a hook-like configuration. Spring arm 720 acts as a cantilever to flex up and down with respect to ring portion 710. As described above, ring portion 710 provides ample surface area to securely couple spring 700 to the top layer of a flex membrane. In one embodiment, ring portion 710 is substantially circular. In another embodiment, ring portion 710 is substantially elliptical.

Figure 8:
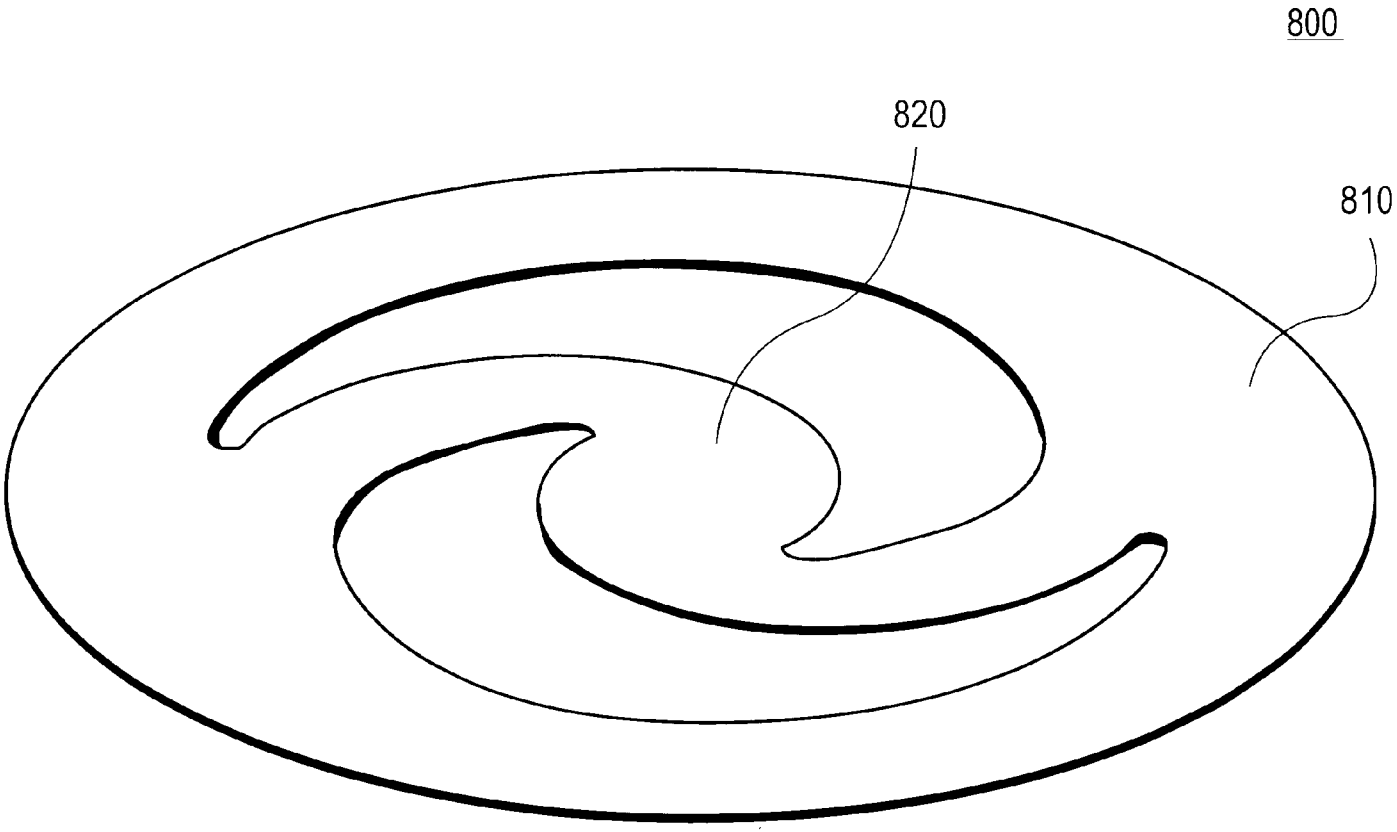
FIG. 8 is a top planar view illustrating one embodiment of a spring.

FIG. 8 illustrates another embodiment of a spring to couple to the top layer of a flex membrane. Similar in design to spring 700, spring 800 has ring portion 810. Spring arm portion 820 extends across ring portion 810. Spring arm portion is substantially symmetrical, having an enlarged contact region near the center of spring 800. Spring arm portion 820 may provide control for the center of spring 800 because spring arm portion 820 extends across ring portion 810. In addition, spring arm portion 820 provides a large contact area for spring 800 and the top layer of a flex membrane.

Figure 9:
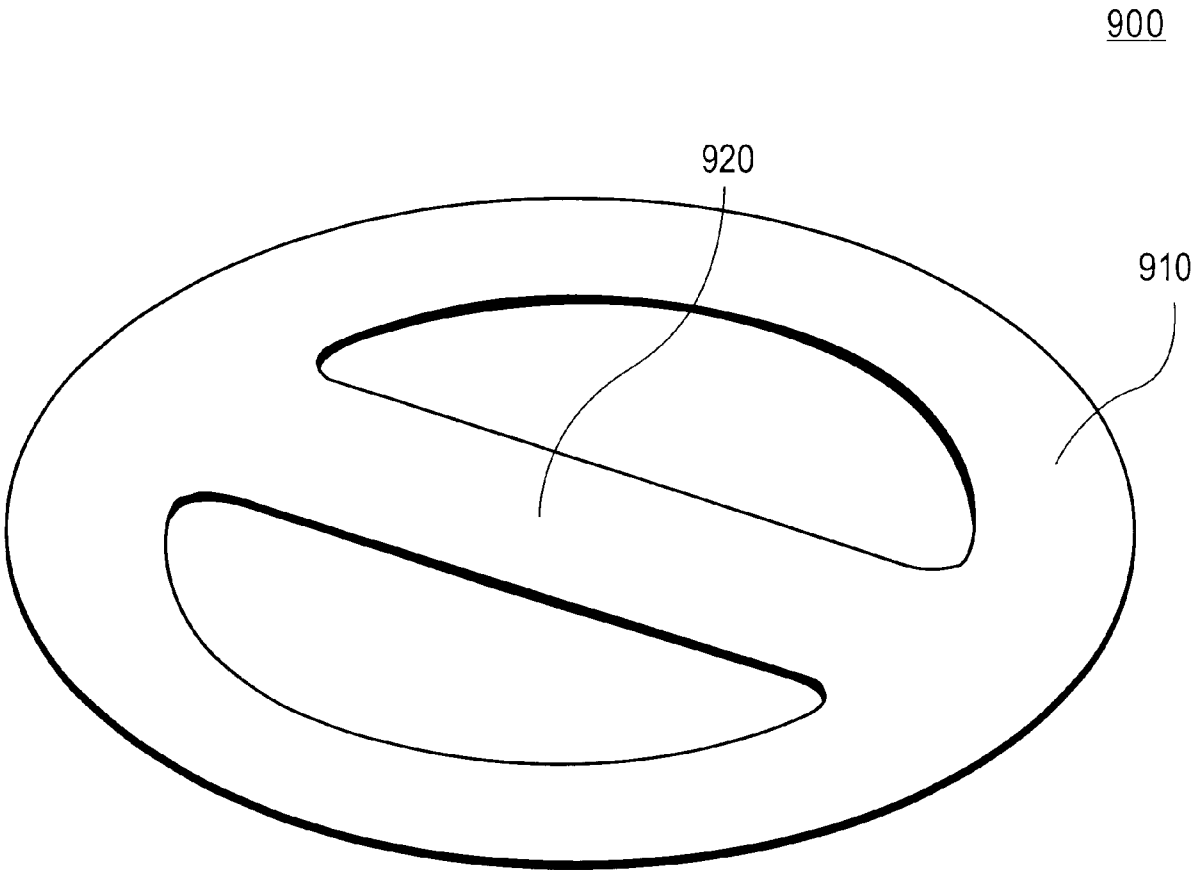
FIG. 9 is a top planar view illustrating one embodiment of a spring.
Figure 10:
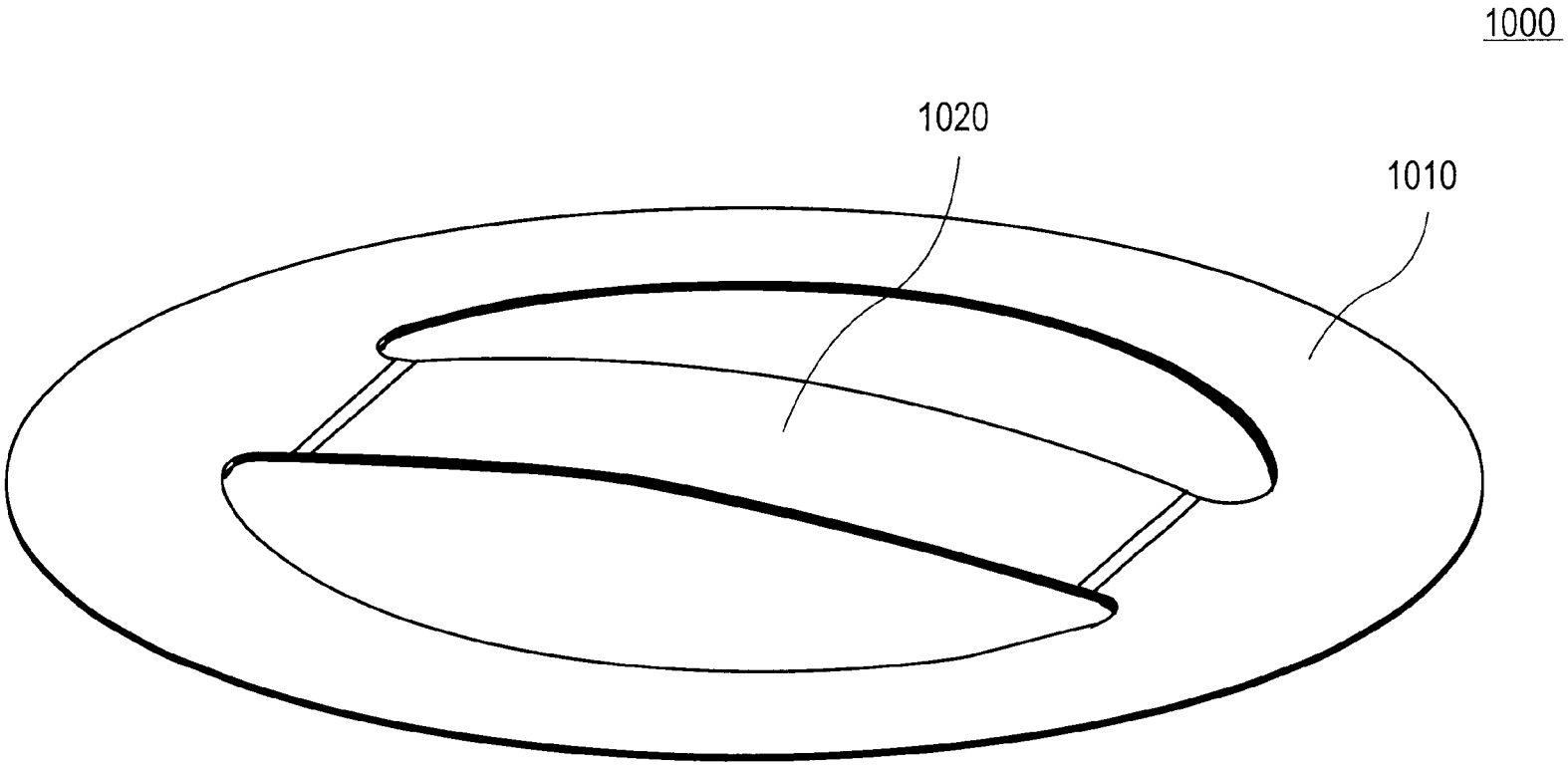
FIG. 10 is a top planar view illustrating one embodiment of a spring.

FIGS. 9, 10 illustrate further embodiments of a spring to couple to the top layer of a flex membrane. Spring 900 of FIG. 9 has ring portion 910 and substantially straight beam 920 extending across a diameter of ring portion 910. Spring 1000 of FIG. 10 also has ring portion 1010 and beam 1020 extending across a diameter of ring portion 1010.

A center region of beam 1020 is bowed such that the center region is higher than the ends of beam 1020. Bowed beam 1020 of spring 1000 may increase support for the top layer of a flex membrane, particularly if spring 1000 is positioned between the top layer and the spacer layer, as illustrated in FIG. 12.

Figure 11:
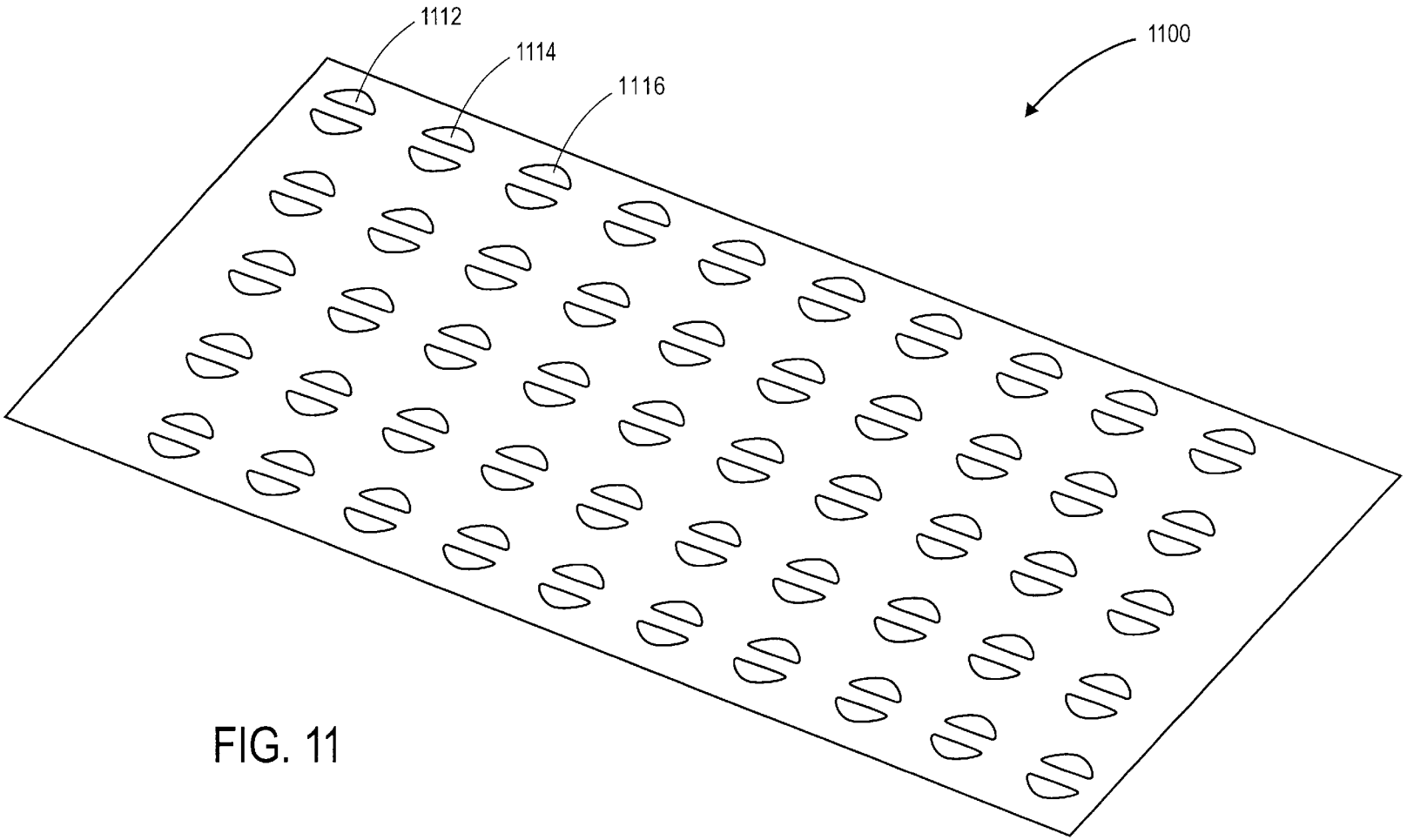
FIG. 11 is a top planar view illustrating one embodiment of a sheet of springs.

FIG. 11 illustrates one embodiment of multiple springs for coupling to flex membranes. As described in the discussion of FIG. 4, the spring may be coupled to the flex membrane as a discrete element, either adhered to the top of the top layer or placed between the top layer and the spacer layer of a three-layer flex membrane. Alternatively, in one embodiment, a sheet containing multiple springs may be coupled to an array of flex membranes during assembly.

Sheet 1100 contains multiple springs for coupling to a set of flex membranes of a key switch array. Springs 1112, 1114, and 1116 are representative of the springs on sheet 1100. During assembly of a set of key switches on a keyboard, sheet 1100 with springs 1112, 1114, and 1116 may be aligned over individual flex membranes (not shown), as described in the discussion for FIGS. 4, 5. This method of coupling a group of springs at once may offer a manufacturing advantage because of the reduction in assembly time and production costs, compared to attaching each spring individually.

The sheet of springs is preferably arranged in a standard QWERTY or similar layout. The springs may be divided into spring sets corresponding to flex membrane sets. Additionally, the spring sets may be divided along staggered lines between membrane sets because the keys are not arranged in straight columns in a standard QWERTY keyboard.

Of course, the sheet of springs can alternatively be aligned in non-QWERTY layouts; for example, key layouts designed for a special purpose devices including workstations, information devices, cellular telephones, or software packages. While the present invention can be embodied in a full-size or standard size keyboard having a 19-millimeter pitch between keys, a reduced size keyboard can also embody the present invention, i.e. a scaled-down version of the foldable keyboard is contemplated.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A key switch, comprising:

a multi-layer flex membrane having a top side and a bottom side; and a spring coupled to the flex membrane, the spring to increase a resiliency of the flex membrane, wherein the spring comprises a ring portion and a beam to extend across a diameter of the ring portion.

2. A key switch, comprising:

a flex membrane, comprising:

a base layer having a top surface, a bottom surface, and a first conductive trace along the top surface of the base layer;

a top layer having a top surface, a bottom surface, and a second conductive trace along the bottom surface of the top layer; and a spacer layer disposed between the base layer and the top layer, the spacer layer having an opening to expose the first conductive trace to the second conductive trace; and a spring disposed between the top layer and the spacer layer, wherein the spring increases a resiliency of the flex membrane.

3. A key switch, comprising:

a flex membrane, comprising:

a base layer having a top surface, a bottom surface, and a first conductive trace along the top surface of the base layer;

a top layer having a top surface, a bottom surface, and a second conductive trace along the bottom surface of the top layer; and a spacer layer disposed between the base layer and the top layer, the spacer layer having an opening to expose the first conductive trace to the second conductive trace; and a spring coupled to the flex membrane, the spring to increase a resiliency of the flex membrane, wherein the spring comprises a ring portion and a beam to extend across a diameter of the ring portion.

4. A flex membrane, comprising:

a base layer having a first conductive trace with a first contact region near a center of the base layer;

a top layer having a second conductive trace with a second contact region near a center of the top layer;

a spacer layer disposed between the base layer and the top layer, the spacer layer having an opening to expose the first contact region of the first conductive trace to the second contact region of the second conductive trace; and a spring coupled to the top layer, the spring to increase a resiliency of the top layer, wherein the spring comprises a ring portion and a beam to extend across a length of the ring portion.

* * * * *